US006280014B1

(12) United States Patent
Sharma et al.

(10) Patent No.: US 6,280,014 B1
(45) Date of Patent: Aug. 28, 2001

(54) CLEANING MECHANISM FOR INKJET PRINT HEAD WITH FIXED GUTTER

(75) Inventors: Ravi Sharma, Fairport; Todd R. Griffin, Rochester; Charles F. Faisst, Jr., Avon, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/460,756

(22) Filed: Dec. 14, 1999

(51) Int. Cl.[7] ..... B41J 2/165; B41J 2/185
(52) U.S. Cl. ..... 347/28; 347/33; 347/90
(58) Field of Search ..... 347/33, 22, 28, 347/89, 90

(56) References Cited

U.S. PATENT DOCUMENTS

| | | | | |
|---|---|---|---|---|
| 4,296,418 | | 10/1981 | Yamazaki et al. . | |
| 4,734,718 | | 3/1988 | Iwagami et al. . | |
| 4,800,403 | | 1/1989 | Accattino et al. . | |
| 4,829,318 | | 5/1989 | Racicot et al. . | |
| 4,879,784 | * | 11/1989 | Shero | 15/322 |
| 4,968,994 | | 11/1990 | Hock et al. . | |
| 5,182,582 | * | 1/1993 | Okamura | 347/33 |
| 5,300,958 | * | 4/1994 | Burke et al. | 347/28 |
| 5,574,485 | * | 11/1996 | Anderson et al. | 347/28 X |
| 5,612,722 | * | 3/1997 | Francis et al. | 347/33 |
| 5,614,930 | | 3/1997 | Osborne et al. . | |
| 5,877,788 | * | 3/1999 | Haan et al. | 347/28 |
| 6,164,751 | * | 12/2000 | Griffin et al. | 347/28 |

FOREIGN PATENT DOCUMENTS

| | | | | |
|---|---|---|---|---|
| 0494693 | | 7/1992 | (EP) . | |
| 56-58875 | * | 5/1981 | (JP) | 347/33 |
| 64-58553 | * | 5/1989 | (JP) | 347/89 |
| 6-115083 | * | 4/1994 | (JP) | 347/33 |

OTHER PUBLICATIONS

U.S. Ser. No. 08/954,317, "Continuous Ink Jet Printer With Asymmetric Heating Drop Deflection", filed Oct. 17, 1997 by James M. Chwalek et al.

U.S. Ser. No. 09/342,371, Continuous InkJet Printer Catcher And Method For Making Same, filed Jun. 29, 1999 by Charles F. Faisst, Jr. et al.

* cited by examiner

*Primary Examiner*—David F. Yockey
(74) *Attorney, Agent, or Firm*—Walter S. Stevens

(57) ABSTRACT

A self-cleaning printer system (400) with a cleaning liquid supply and a wiper blade assembly (32) includes a print head (16) defining a plurality of ink channels therein, each ink channel terminating in an ink ejection nozzle (25). The print head (16) also has a surface (15) thereon surrounding all the nozzles (25). The wiper blade assembly (32) is disposed relative to the surface (15) and/or nozzles (25) for directing a flow of cleaning liquid along the surface (15) and/or across the nozzles (25) and to direct sliding contact of a wiper blade (195) to clean a contaminant from the surface (15) and/or nozzles (15). The wiper blade assembly (32) is configured to introduce the cleaning liquid to the print head surface (15) to facilitate and augment cleaning by the wiper blade (190). In addition, the wiper blade (190) is combined with channels for delivery of the cleaning liquid and vacuum suction to remove cleaning liquid (250 and 260, respectively).

22 Claims, 16 Drawing Sheets

CLEANING MECHANISM FOR INKJET PRINT HEAD WITH FIXED GUTTER

FIELD OF THE INVENTION

This invention generally relates to a self-cleaning ink jet printer and methods for cleaning same and more particularly to a wiper blade assembly for an ink jet printer having a fixed canopy-type gutter.

BACKGROUND OF THE INVENTION

An ink jet printer produces images by ejecting ink droplets onto a receiver medium in an imagewise fashion. The advantages of non-impact, low-noise, low energy use, and low cost operation in addition to the capability of the printer to print on plain paper mediums are largely responsible for the wide acceptance of ink jet printers in the marketplace.

"On demand" ink jet printers utilize a pressurization actuator to produce the ink jet droplet at orifices of a print head. In this regard, either one of two types of actuators may be used including heat actuators and piezoelectric actuators. With heat actuators, a heater placed at a convenient location heats the ink and a quantity of the ink will phase change into a gaseous steam bubble and raise the internal ink pressure sufficiently for an ink droplet to be expelled to the recording medium. With respect to piezoelectric actuators, a piezoelectric material possessing properties such that an electric field is produced when a mechanical stress is applied. The converse also holds true; that is, an applied electric field will produce a mechanical stress in the material. Some naturally occurring materials possessing these characteristics are quartz and tourmaline. The most commonly produced piezoelectric ceramics are lead zirconate titanate, barium titanate, lead titanate, and lead metaniobate.

In the case of "continuous" ink jet printers, electrostatic charging tunnels are placed close to the point where ink droplets are being ejected in the form of a stream. Selected droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium.

Recently a new type of continuous ink jet printer has been disclosed. U.S. patent applications bearing Ser. No. 08/954317, now U.S. Pat. No. 6,079,821, and Ser. No. 09/342,371 to Chwalek et al., which describe a continuous ink jet printer in which on demand asymmetric heating of an ink jet causes selected drops to deflect. In one mode of operation, selected drops are deflected toward an image-recording medium while the other drops are intercepted in a canopy-type gutter that is placed in close proximity (for example, 3 mm) to the ink jet nozzle plate.

Inks for high speed ink jet printers, whether of the "continuous" or "piezoelectric" type, must have a number of special characteristics. For example, the ink should incorporate a nondrying characteristic, so that drying of ink in the ink ejection chamber is hindered or slowed to such a state that by occasional spitting of ink droplets, the cavities and corresponding nozzles are kept open. The addition of glycol facilitates free flow of ink through the ink jet chamber. Of course, the ink jet print head is exposed to the environment where the ink jet printing occurs. Thus, the previously mentioned nozzles are exposed to many kinds of air born particulates. Particulate debris may accumulate on surfaces formed around the nozzles and may accumulate in the nozzles and chambers themselves. That is, the ink may combine with such particulate debris to form an interference burr that blocks the nozzle or that alters surface wetting to inhibit proper formation of the ink droplet. The particulate debris should be cleaned from the surface and nozzle to restore proper droplet formation. In the prior art, this cleaning is commonly accomplished by brushing, wiping, spraying, vacuum suction, and/or spitting of ink through the nozzle.

Thus, ink jet printers can be said to have the following problems: the inks tend to dry-out in and around the nozzles resulting in clogging of the nozzles; and the wiping of the nozzle plate causes wear on plate and wiper, the wiper itself producing particles that clog the nozzle. In addition, cleaning an ink jet nozzle plate that has limited accessibility due to the placement of a fixed gutter poses extra demands on the design of cleaning members and on methods used.

Ink jet print head cleaners are known. A wiping system for ink jet print heads is disclosed in U.S. Pat. No. 5,614,930 titled "Orthogonal Rotary Wiping System For Ink jet Printheads" issued Mar. 25, 1997 in the name of William S. Osborne et al. This patent discloses a rotary service station that has a wiper supporting tumbler. The tumbler rotates to wipe the print head along a length of linearly aligned nozzle. In addition, a wiper scraping system scrapes the wipers to clean the wipers. However, Osborne et al. do not disclose use of an external solvent to assist cleaning and also does not disclose complete removal of the external solvent. Also a wiper scraping system is limited by the size constraints imposed by the print head itself. This is particularly true for fixed gutter ink jet print head systems which partially encloses the print head surfaces. Fixed gutter systems require a mechanism that can work within small tolerances imposed by the integrated gutter in order to clean the print head.

Therefore, there is a need to provide a suitable ink jet printer with cleaning mechanism, and method of assembling same, which cleaning mechanism is capable of cleaning the print head surface. There is also a need to supply cleaning liquid to lubricate and aid cleaning in a manner that does not cause wear of the print head nozzle plate. Furthermore there is a need for a mechanism that can operate within the small tolerances imposed by an fixed canopy-type gutter.

SUMMARY OF THE INVENTION

It is an object of the present invention to provide a self-cleaning ink jet printer with a cleaning mechanism and method of assembling same, which cleans a surface of a print head belonging to the printer.

It is another object of the present invention to provide an ink jet print head assembly that includes a cleaning mechanism and method of assembling same that can be used in fixed gutter continuous ink jet printers.

With the above objects in view, disclosed is a wiper blade assembly for use in a self-cleaning printer, the printer comprising a print head having a print head surface and an ink channel therein; a structural member that functions as a gutter for collecting ink is disposed opposite to the print head surface; the cleaning mechanism adapted to simultaneously clean contaminant from the print head surface.

According to an exemplary embodiment of the present invention, disclosed is a self-cleaning printer comprising a print head defining a plurality of ink channels therein, each ink channel terminating in a nozzle. The print head also has a surface thereon surrounding all the nozzles. The print head is capable of jetting ink through the nozzles, which ink jets are subsequently heated to cause drops to form and to selectively deviate drops for printing. Ink drops are either intercepted by a receiver or a gutter. In one method of operation, ink is selectively deflected onto a receiver (e.g., paper or transparency) supported by a platen disposed adjacent the print head, while the non-deflected ink drops are intercepted by the gutter. Ink intercepted by the gutter may be recycled. Contaminant such as an oily film-like deposit or particulate matter may reside on the surface and may completely or partially obstruct the nozzle. The oily film may, for example, be grease and the particulate matter may be particles of dirt, dust, metal and/or encrustations of dried ink. Presence of the contaminant interferes with proper ejection of the ink droplets from their respective nozzles and therefore may give rise to undesirable image artifacts, such as banding. It is therefore desirable to clean the contaminant from the surface and the nozzles.

Therefore, a cleaning mechanism is disposed relative to the surface and/or nozzle for directing a flow of cleaning liquid along the surface and/or across the nozzle and to direct sliding contact of a wiper blade assembly to clean the contaminant from the surface and/or nozzle. As described in detail herein, the cleaning mechanism is configured to introduce cleaning liquid to the print head surface to facilitate and augment cleaning by the wiper blade assembly. In addition, the wiper blade assembly includes a wiper body and may have internal channels for delivery of cleaning liquid and vacuum suction to remove cleaning liquid. Alternatively, the wiper blade may be combined with a separate member containing channels for supply of cleaning liquid and suction at the wiper blade tip area. In another embodiment, cleaning liquid may be supplied to the print head surface through channels provided in the gutter. In this case, vacuum channels in the wiper blade can be used to remove cleaning liquid from the print head surface. A pump for supplying cleaning liquid through the wiper blade or the gutter and for providing suction to vacuum channels in the wiper blade is provided. In addition, a filter is provided to filter the particulate matter from the liquid for later disposal. Wiping pads are also provided to remove dirt adhering to the wiper blades. In yet another embodiment, the wiper blade body may be combined with an ultrasonic transducer.

A feature of the present invention is the provision of a slim wiper blade with channels for liquid and vacuum supply that fits in the restricted space between the print head surface and the gutter and is capable removing contaminant from the surface and/or nozzle.

Another feature of the present invention is the provision of a piping circuit to deliver and remove cleaning liquid from the print head surface.

Yet another feature of the present invention is the provision of a mechanism to align and transport the wiper blade during cleaning operation.

Yet another feature of the present invention is the provision of an ultrasonic transducer to energize the cleaning action by the wiper blade and the cleaning liquid.

An advantage of the present invention is that the cleaning assembly belonging to the invention cleans the contaminant from the surface and/or nozzle in the confined space between the print head surface and the fixed gutter.

These and other objects, features and advantages of the present invention will become apparent to those skilled in the art upon a reading of the following detailed description taken in conjunction with the appended drawings which show and describe illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description taken in conjunction with the accompanying drawings wherein:

Numerals and parts in the detailed description correspond to like references in the figures unless otherwise indicated.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
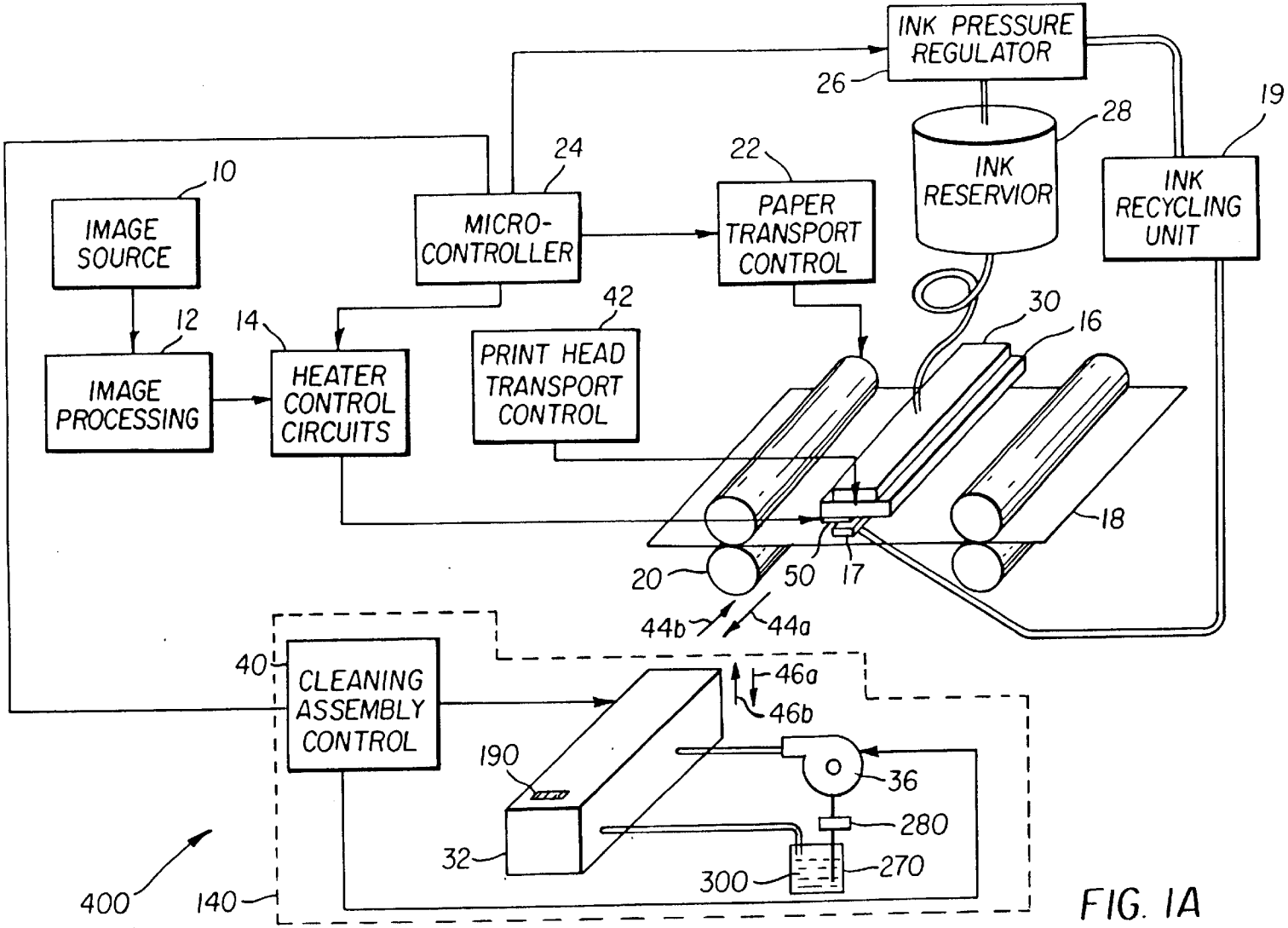
FIG. 1A shows a simplified block schematic diagram of a first embodiment printer equipped with a page width print head with fixed gutter and cleaning mechanism disposed adjacent to the print head.
Figure 1B:
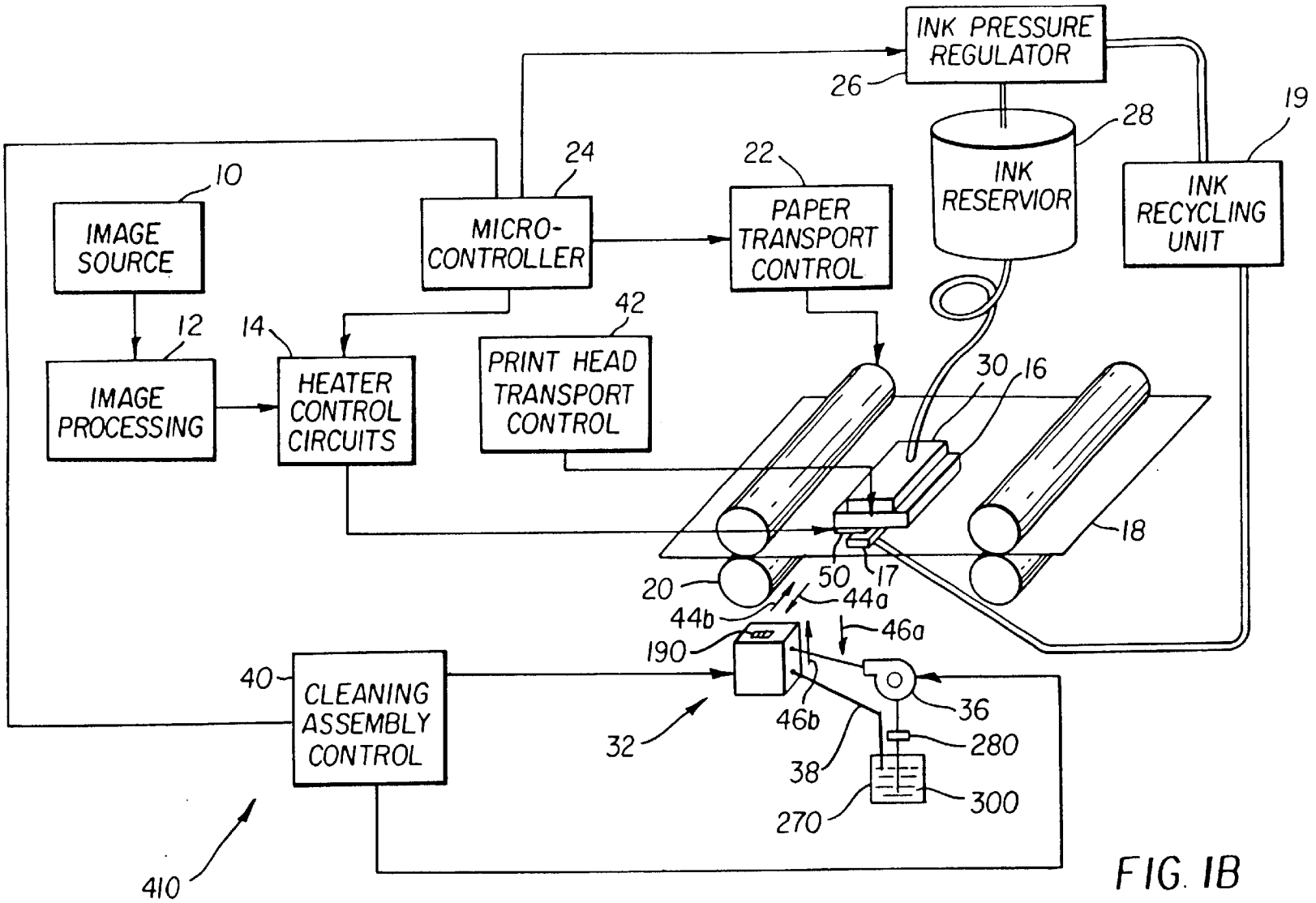
FIG. 1B shows a simplified block schematic diagram of a first embodiment printer, the printer equipped with a reciprocating print head with fixed gutter and cleaning mechanism disposed adjacent to the print head.
Figure 3:
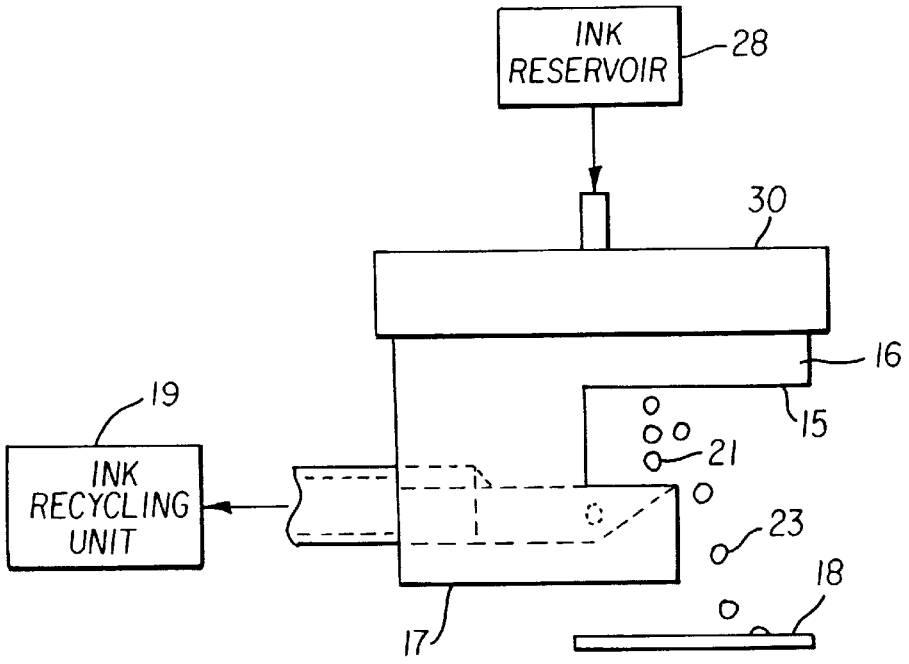
FIG. 3 is a side view of a print head according to the invention, showing deflected ink drops directed toward a receiving medium and non-deflected ink drops intercepted by the fixed gutter.

Therefore, referring to FIGS. 1A and 1B, therein are shown embodiments denoted generally as 400 and 410, respectively, for a self-cleaning printer system which includes an image source 10 such as a scanner or a computer that provides raster image data, outline image data in the form of a page description language, or other forms of digital image data. The image source 10 is converted to half-toned bitmap image data by an image processing unit 12 which stores the image data in memory. A plurality of heater control circuits 14 read the data from memory within the image processing unit 12 and apply time-varying electrical pulses to a set of nozzle heaters 50 that are part of a print head 16. The action of the nozzle heaters 50 and print head 16 using printing is shown in FIG. 3 wherein the electrical pulses are applied at an appropriate time, and to the appropriate nozzle, so that drops 23 form a continuous ink jet stream to create spots on a recording medium 18, typically paper, in an appropriate position designated by the data in the memory of the image processing unit 12. Non-deflected ink drops 21 formed in the non-printing area are intercepted by the gutter 17 which, as shown, is fixed in relation to the print head 16.

Referring to FIGS. 1A and 1B, recording medium 18 is moved relative to the print head 16 by a recording medium transport system 20, which is electronically controlled by a paper transport control system 22, and which in turn is controlled by a micro-controller 24. The paper medium transport system 22 shown in FIGS. 1A and 1B is shown in schematic form only, and many different mechanical configurations are possible, as is known to those of skill in the art. For example, a transfer roller could be used as a paper medium transport system 22 to facilitate transfer of the ink drops 23 to recording medium 18. Such transfer roller technology is well known in the art. In the case of page width print heads, it is most convenient to move the recording medium 18 past a stationary print head. However, in the case of a scanning print system (as shown schematically in FIG. 1B), it is usually most convenient to move the print head along one axis (the sub-scanning direction) and the recording medium 18 along an orthogonal axis (the main scanning direction) in a relative raster motion.

Referring to FIGS. 1A, 1B, 3 and 4, ink is contained in an ink reservoir 28 under pressure. In the non printing state, continuous ink jet drop streams are unable to reach the recording medium 18 due to the position of gutter that blocks the stream to allow a portion of the ink to be recycled by an ink recycling unit 19. The ink recycling unit 19 reconditions the ink and feeds it back to ink reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

Figure 2:
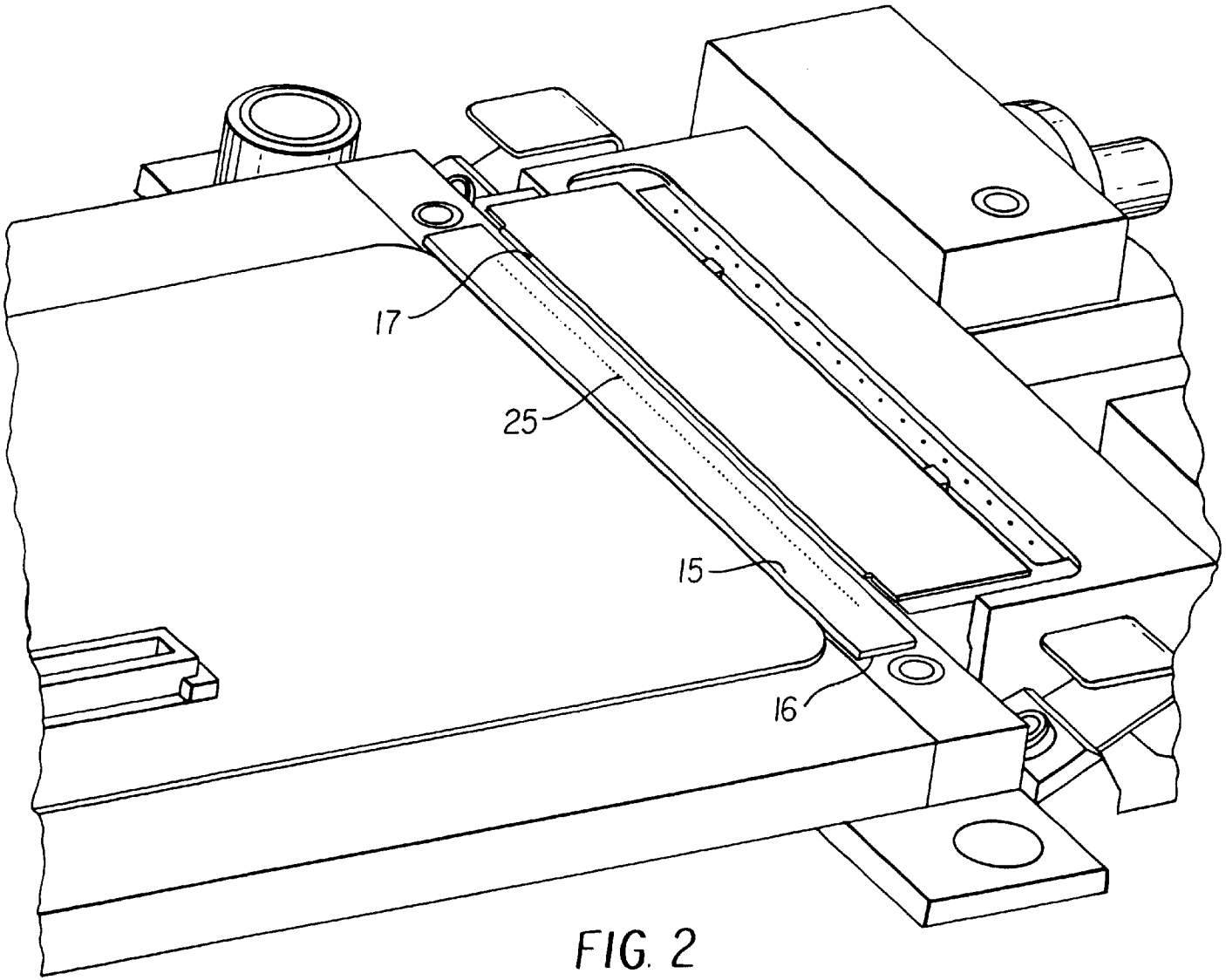
FIG. 2 is an isotropic view of the print head with fixed gutter, the print head defining a plurality of channels therein, each channel terminating in a nozzle.
Figure 4:
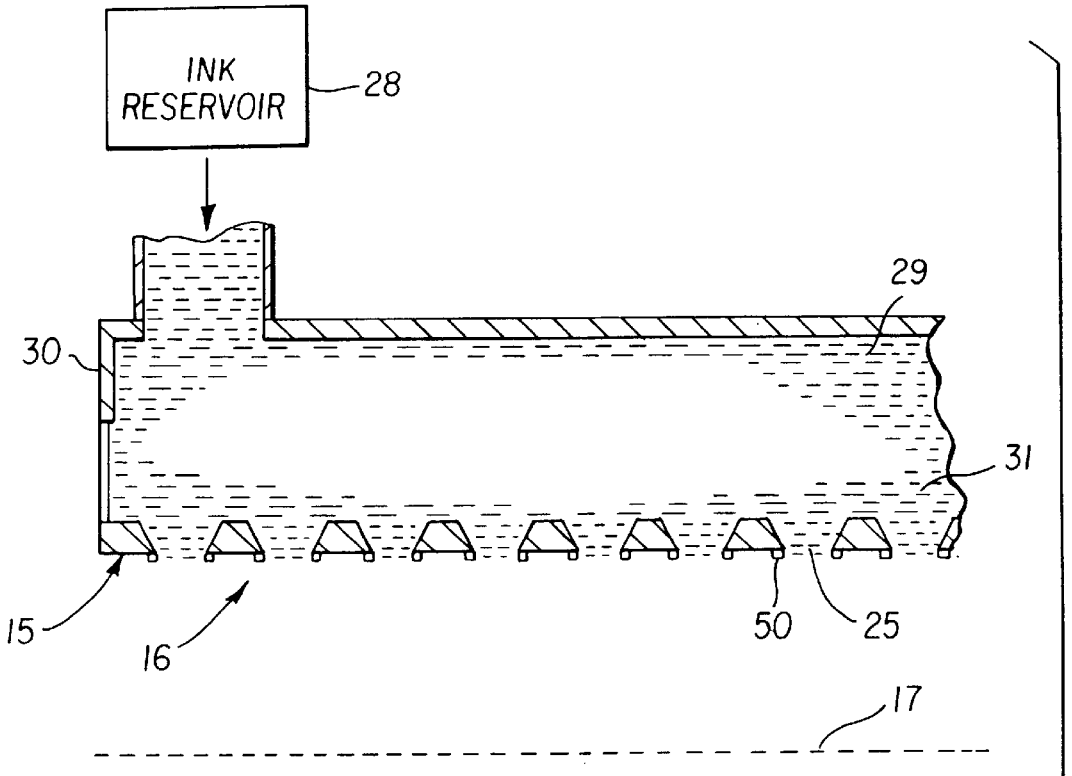
FIG. 4 is a fragmented view in cross-section of the print head shown in FIG. 3.

The ink is distributed to the back surface of the print head 16 by an ink channel device 30 and through ink channel 31, as shown in FIG. 4. The ink preferably flows through slots and/or holes etched through silicon substrate of print head 16 to its front surface 15, where a plurality of nozzles 25 and heaters 50 are situated. FIG. 2 is an isotropic view of the print head 16 and gutter 17. With print head 16 fabricated from silicon, it is possible to integrate heater control circuits 14 with the print head 16. Non-deflected ink drops 21 are intercepted by gutter 17, while deflected ink drops 23 land on the recording medium 18. Deflection may be caused by a variety of methods including the asymmetric heating method discussed in U.S. patent application Ser. No. 08/954317, now U.S. Pat. No. 6,079,821, to Chwalek et al.

Figure 5:
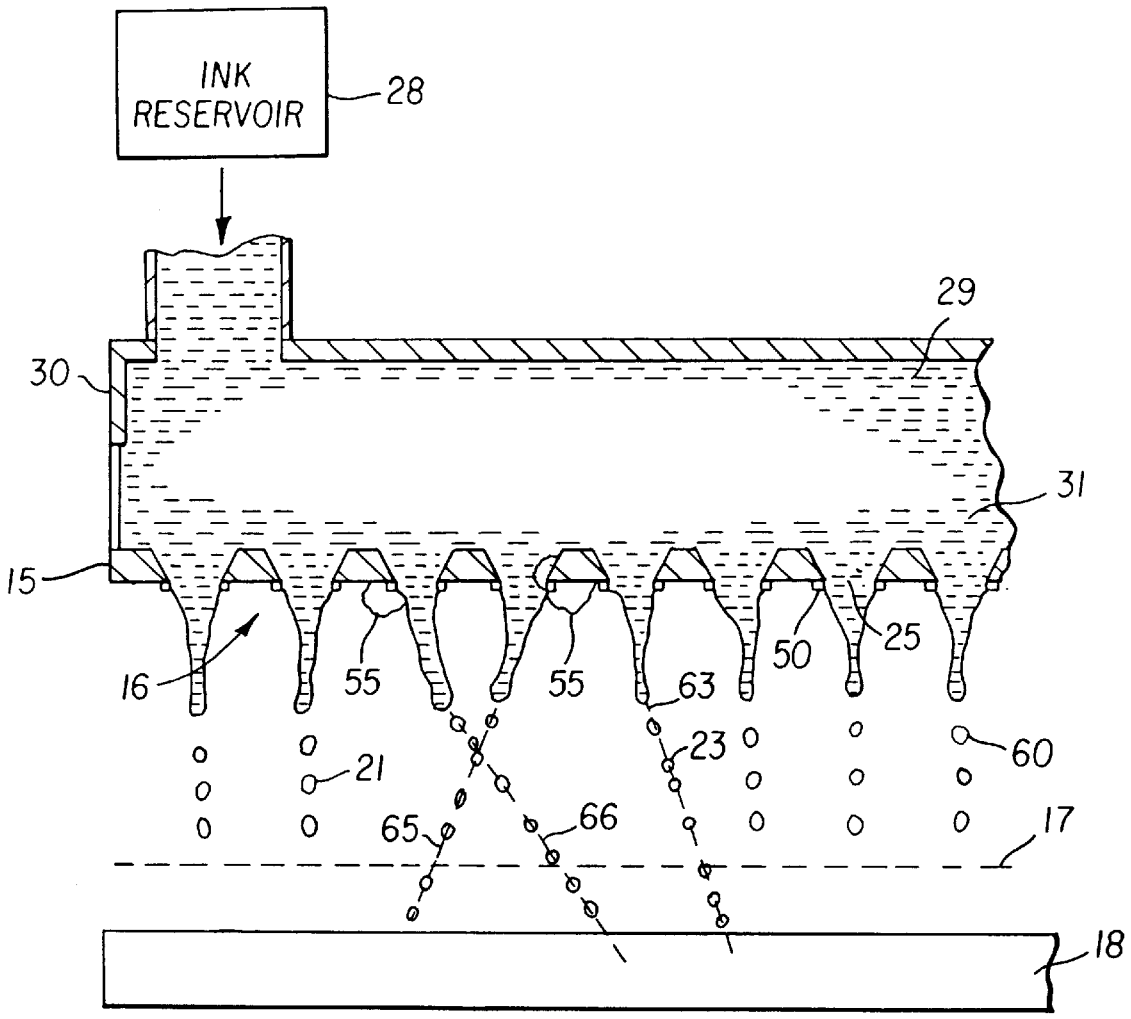
FIG. 5 is a fragmented view in cross-section of a contaminated print head with schematic representation of misaligned ink drops due to contaminant.

Turning now to FIG. 5, it has been observed that the front surface 15 may become fouled by contaminant 55. Contaminant 55 may be, for example, an oily film or particulate matter residing on the surface of front surface 15. Contaminant 55 also may partially or completely obstructs one or more of the plurality of nozzles 25. The particulate matter may be, for example, particles of dirt, dust, metal and/or encrustations of dried ink. The oily film may be, for example, grease or the like. Presence of contaminant 55 is undesirable because when contaminant 55 completely obstruct one or more of the plurality of nozzles 25, ink is prevented from being ejected from nozzle 25. In this regard, the terms "nozzle" and "nozzles" are used interchangeably throughout either in the singular or plural as may be appropriate.

Also, when contaminant 55 partially obstructs nozzle 25, flight of ink droplets 60 may be diverted from first axis 63 to travel along a second axis 65 (as shown). If ink droplets 60 travels along second axis 65, ink droplets 60 will land on recording medium 18 in an unintended location. In this manner, such complete or partial obstruction of nozzle 25 leads to printing artifacts such as "banding", a highly undesirable result. A similar printing artifact results if non-selected drops 21 travels on third axis 66. Also, the presence of contaminant 55 may alter surface wetting and inhibit proper formation of a droplets 60. Therefore, it is desirable to clean (i.e., remove) contaminant 55 to avoid these and other printing artifacts.

Therefore, the self-cleaning printer systems 400 and 410 are equipped with a cleaning mechanism 140 that can be used for simultaneously removing contaminant 55 from front surface 15 of the print head 16 and the nozzles 25, according to the invention. The cleaning mechanism 140 includes a wiper blade assembly 32, disposed for directing flow of cleaning liquid 300 using wiper blade 190 that moves along the surface 15 and across nozzles 25 to clean contaminant 55 therefrom. The cleaning liquid 300 mentioned hereinabove may be any suitable liquid solvent composition, such as water, isopropanol, diethylene glycol, diethylene glycol monobutyl ether, octane, acids and bases, surfactant solutions and any combination thereof. Complex liquid compositions may also be used, such as microemulsions, micellar surfactant solutions, vesicles and solid particles dispersed in the cleaning liquid 300.

Figure 6A:
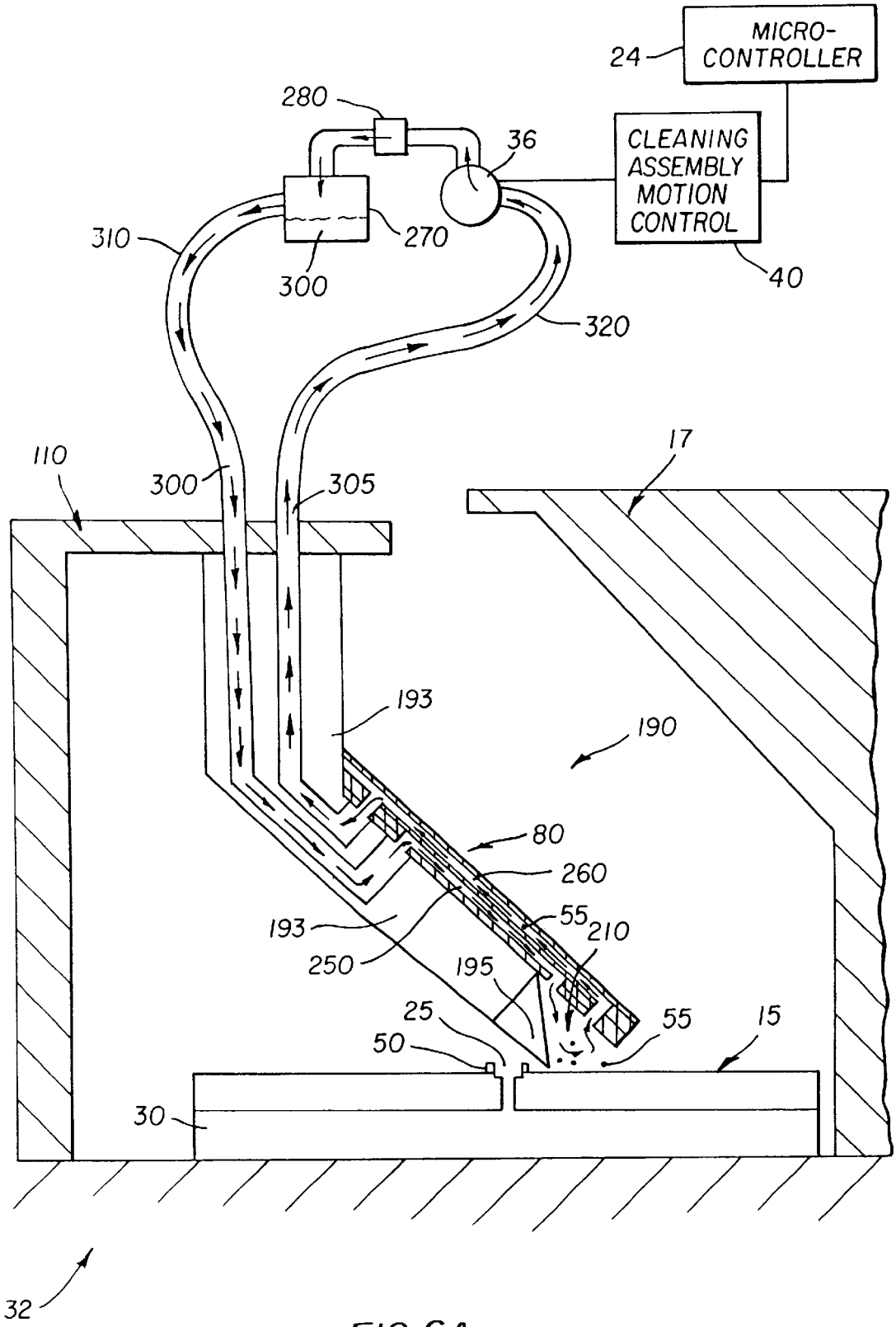
FIG. 6A is an enlarged section view of a cleaning mechanism including a wiper blade assembly showing the flow of cleaning liquid and removal of contaminant from print head surface, according to a first exemplary embodiment.

A schematic of the wiper blade assembly 32 in cross section is shown in FIG. 6A. The wiper blade assembly 32 is constructed by attaching a canopy 80 and wiper blade 190 to wiper a body 193. Wiper blade 190 is preferably constructed of elastomeric material such as polyurethane with a "Shore A" hardness of 70–80. Preferably, the tip of the wiper blade 190 has a beveled edge 195. The canopy 80 is constructed with internal channels 250, 260 to supply filtered or unused cleaning liquid 300 to the front surface 15 and to supply suction to remove used cleaning solution 305. As shown, cleaning liquid 300 is delivered through channel 250 and suction is exerted through channel 260 by connection to circulation pump 36.

Through this arrangement, a flow of the cleaning liquid 300 is set up in the gap 210 formed in the space between the wiper blade 190, the canopy 80, and the front surface 15, affording cleaning of contaminant 55 from the front surface 15 as well as nozzles 25. The flow of the cleaning liquid 300 may be reversed if needed by switching the channels 250 and 260. In one embodiment, the canopy 80 is attached with its channels 250 and 260 aligned and drilled through wiper body 193. The wiper body 193 is supplied with cleaning liquid 300 from cleaning liquid reservoir 270 with the used cleaning solution 305 flowing through the filter the by the action of circulation pump 360. Suction (vacuum) is also applied by circulation pump 360. It will be appreciated that flexible piping may be used to construct the flow tubes 310 and 370 used to carry the cleaning liquid, both filtered 300 and used 305, through the wiper blade assembly 32. Alternatively a separate pump (not shown) may be used to supply suction to wiper body 193. The filter 280 is used to remove contaminant in the used cleaning liquid 305.

In operation, upon receiving suitable electronic signals from the micro-controller 24 and the cleaning assembly control 40, print head 16 is translated along direction of first arrow 44*a* and the wiper blade assembly 32 is lifted in direction of fourth arrow 46*b* with an elevator (not shown) or other similar device. The wiper blade assembly 32 is preferably pre-aligned to contact with the front surface 15 and avoid collision with the gutter 17. Alternatively, the cleaning assembly 32 can have additional translation and alignment to ensure precise docking between the wiper blade assembly 32 and the surface 15. As the print head 16 moves in direction of first arrow 44*a* toward wiper blade assembly 32, contaminate 55 is cleaned by the wiper blade 190 as the wiper blade 190 comes in contact with the surface 15. Additionally, due the flow of cleaning liquid and vacuum suction provided to the canopy, nozzles 25 will also be cleaned. At the end of the translation of the print head 16, the wiper blade assembly 32 is lowered in direction of third arrow 46*a* to disengage the wiper blade 190 from the surface 15. The print head 16 is then translated back along direction of second arrow 44*b* to its printing position and wiper blade assembly 32 is raised along direction of fourth arrow 46*b* to receive print head 16 during the next cleaning operation.

Figure 6B:
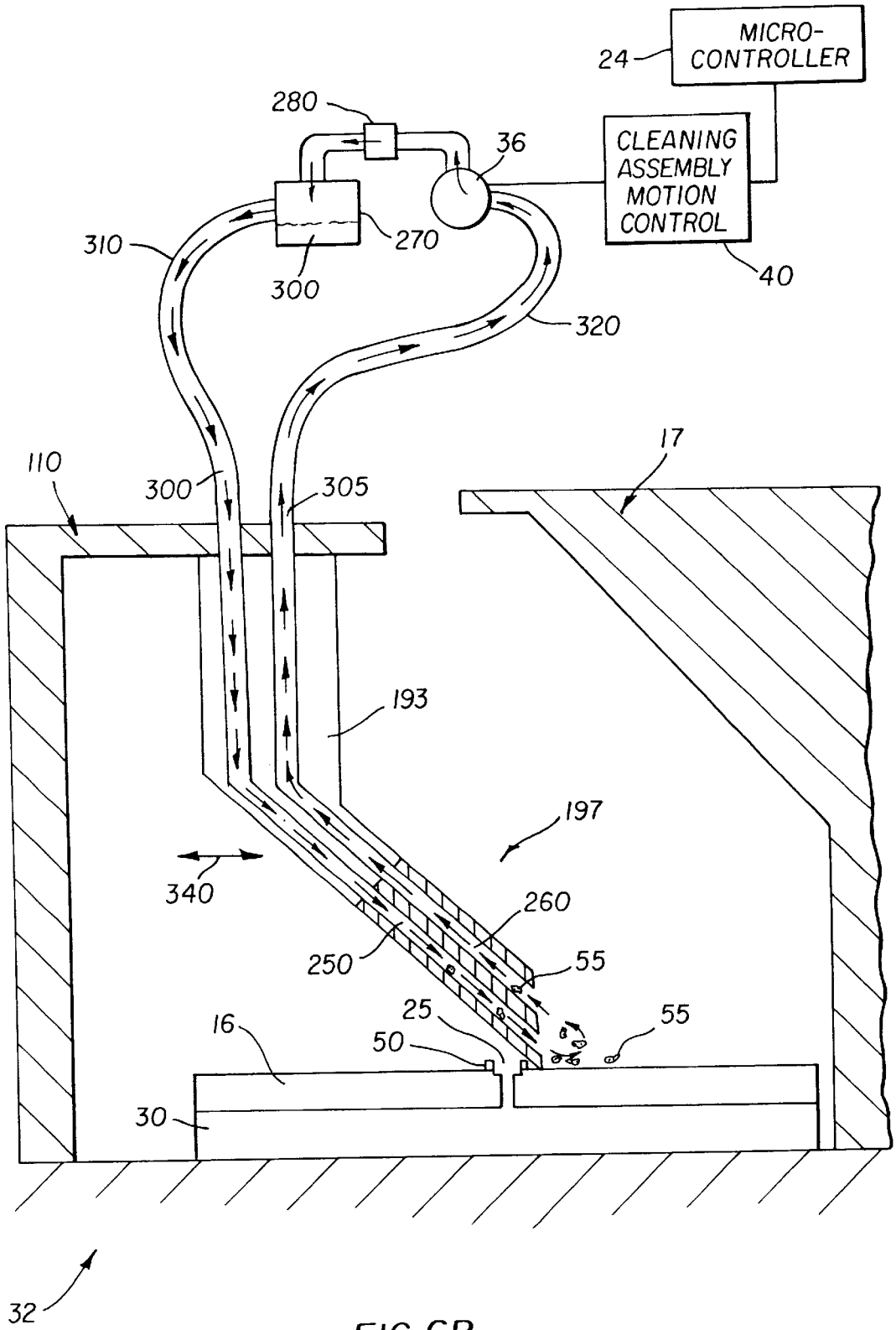
FIG. 6B is an enlarged section view of a cleaning mechanism wiper blade assembly having internal channels for transporting cleaning liquid and showing the flow of cleaning liquid and removal of contaminant from a print head surface, according to a second exemplary embodiment.

The wiper blade assembly 32 is one example of many designs that may be used to clean the surface 15 of a print head 16 and nozzles 25. As such, FIG. 6B illustrates an alternative wiper blade assembly denoted generally as 197, with internal channels 250 and 260 adapted for transporting the cleaning liquid 300 and supplying suction. Alternatively, another design would include a wiper blade with no internal channels wherein the cleaning liquid 300 is delivered using a separate means. Yet another design would be a wiper blade with just suction channels to remove cleaning liquid 300 supplied through other devices such as gutter 17.

In one embodiment, the ink 29 itself is used as a cleaning solution. Referring again to FIGS. 1A, 1B, and 2, the ink 29 may be delivered to surface 15 through nozzles 25 using low positive pressure exerted by pressure regulator 26. Therefore, it is expected that such alternative wiper blade designs may be substituted for the wiper blade assembly 32.

Figure 7:
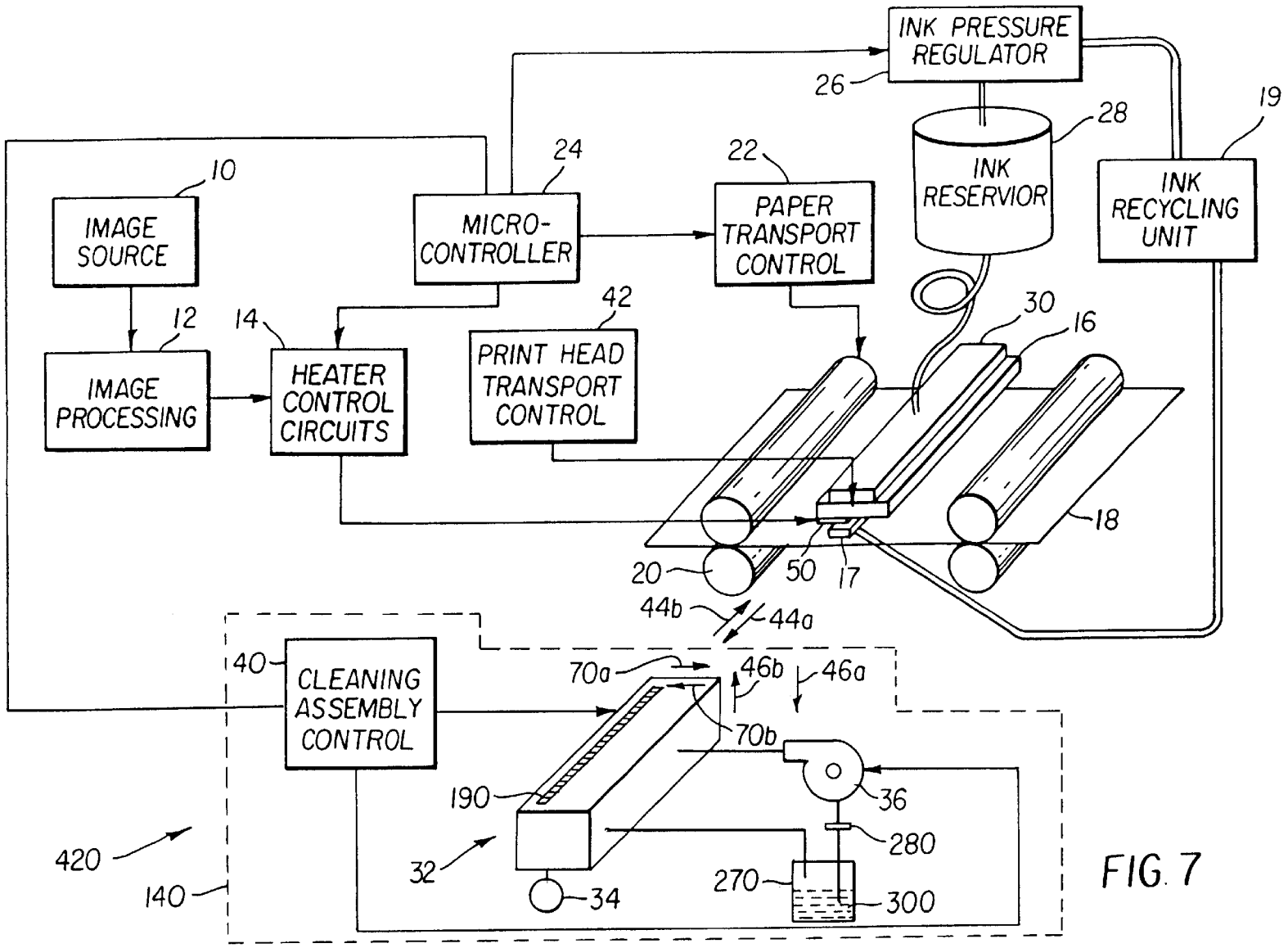
FIG. 7 shows a simplified block schematic diagram of an exemplary second embodiment printer equipped with a page width print head with fixed gutter and cleaning mechanism disposed adjacent to the print head.

Note that in the arrangement shown in FIGS. 1A and 1B, the wiper blade 190 crosses one of the nozzles 25 at a time, possibly pushing contaminant 55 toward another nozzle. In order to avoid pushing contaminant 55 toward other nozzles, it is advantageous to translate the wiper blade assembly 32 in the direction of fifth arrow 70*a* as shown in FIG. 7. Therefore, according to another embodiment of the present invention, a self-cleaning ink jet printer system 420 is disclosed and equipped with a wiper blade assembly 32 having a wiper blade 190 whose length is at least equal to the length of the print head 16 when translated in direction of fifth arrow 70*a*.

In operation, upon receiving the appropriate electronic signals from the cleaning assembly controller 40 and the micro-controller 24, the print head 16 is translated toward wiper blade assembly 32 in direction of first arrow 44*a* to a predetermined position. Upon receiving an electronic signal from micro-controller 24 via cleaning assembly motion control 40, wiper blade assembly 32 is elevated in direction of fourth arrow 46*b* using elevator (not shown) causing the wiper blade 190 to engage with surface 15. The wiper blade 190 is then caused to slide using a motor (not shown) in direction of fifth arrow 70*a*.

When the wiper blade assembly 32 moves so that the wiper blade 190 makes sliding contact with print head front surface 15. The wiper blade 190 cleans all the nozzles 25 at the same time preventing contaminant 55 from being pushed from nozzle to nozzle. The wiper blade assembly 32 can be programmed to move at a pre-determined speed and for a predetermined distance in order to avoid colliding with the gutter 17. At the end of travel, the wiper blade assembly 32 may be retracted along the direction of sixth arrow 70*b* while in sliding contact with surface 15. Alternatively, the wiper blade assembly 32 can be lowered along the direction of third arrow 46*a* using an elevator (not shown) to disengage the wiper blade 190 from surface 15 before the wiper blade assembly 32 is retracted along direction of sixth arrow 70*b*. While the wiper blade assembly 32 is in the rest position, micro-controller 24 may be optionally programmed to cycle cleaning liquid 300 through gap 210 in-order to clean the wiper blade 190. It will be appreciated that FIG. 7 depicts a page width print head by way of example only. Scanning type print heads that are smaller than page width size can also be cleaned using a variation of the method described above.

Figure 8:
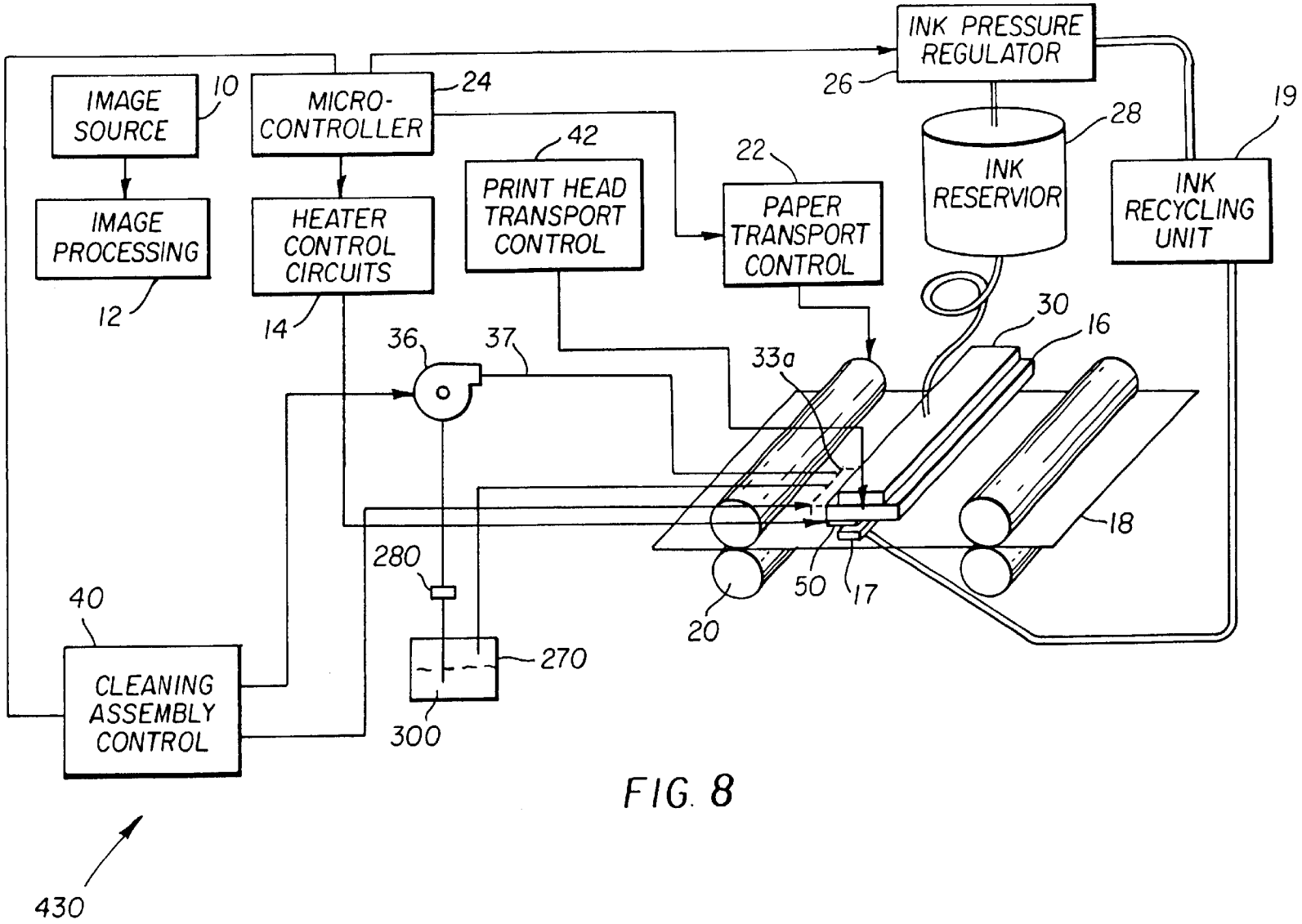
FIG. 8 shows a simplified block schematic diagram of an exemplary third embodiment printer equipped with a reciprocating print head with fixed gutter and cleaning mechanism disposed on the same block as print head.
Figure 9:
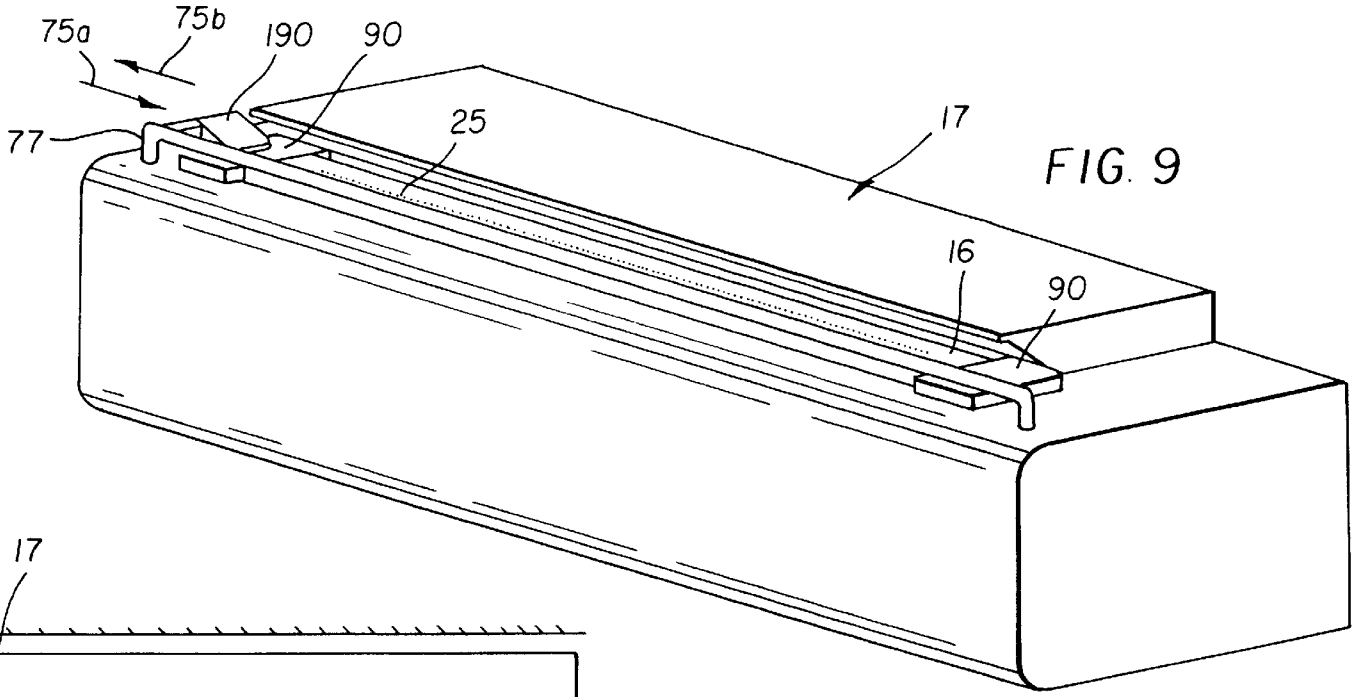
FIG. 9 shows an isometric view of print head with a wiper blade assembly aligned for widthwise translation.
Figure 10:
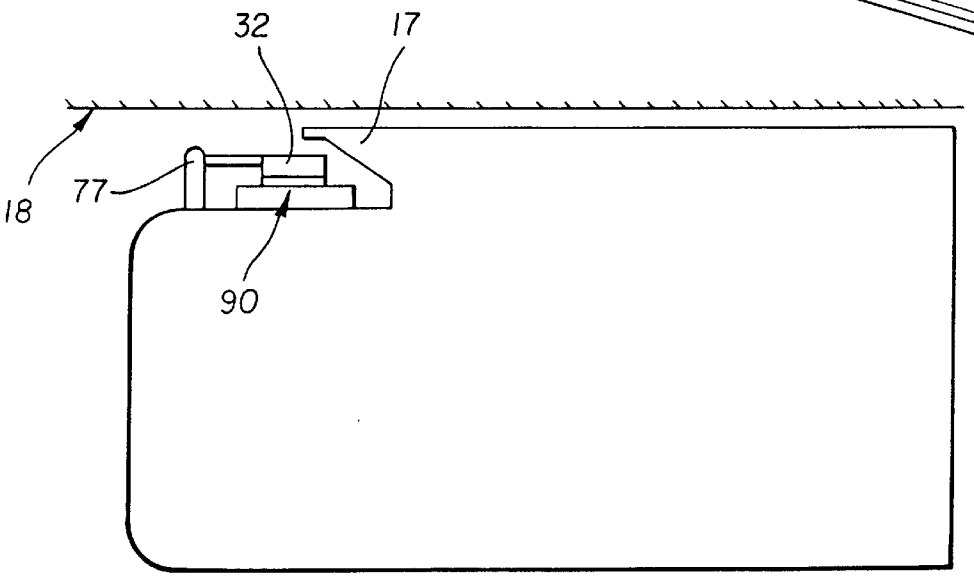
FIG. 10 shows a side view of the wiper blade assembly of FIG. 9 aligned for widthwise translation.

Referring to FIGS. 8, 9 and 10, there is shown a third embodiment of self cleaning printer system 430 capable of simultaneously removing contaminant 55 from surface 15 and nozzles 25. The printer system 430 is substantially similar to printer system 400, except that the wiper blade assembly 33*a* is mounted on the same block as the print head 16. According to the third embodiment printer system 430, the wiper blade assembly 33*a* is mounted adjacent to print head 16 and pre-aligned with the surface 15 and gutter 17. Upon receiving an appropriate electrical signal from the cleaning assembly controller 40 and the micro-controller 24, the wiper blade assembly 33*a* is activated to translate along direction of seventh arrow 75*a* using guide bar 77, as shown in FIG. 9. The motor driving the wiper blade assembly 33*a* is not shown.

Micro-controller 24 and the cleaning assembly controller 40 also provide the electronic signals to activate cleaning liquid supply and suction to the canopy 80 during wiping action on surface 15. Also provided are optional wiping pads 90 for removing dirt from the wiper blade 190. The wiper blade assembly 33*a* may then be slid back while maintaining contact with surface 15 to its rest position along direction of eighth arrow 75*b*. Alternatively, the wiper blade assembly 33*a* may be lifted and then translated along direction of eighth arrow 75*b* to its rest position. Mechanisms for lifting and translation are not shown as they are well known in the art.

Figure 11:
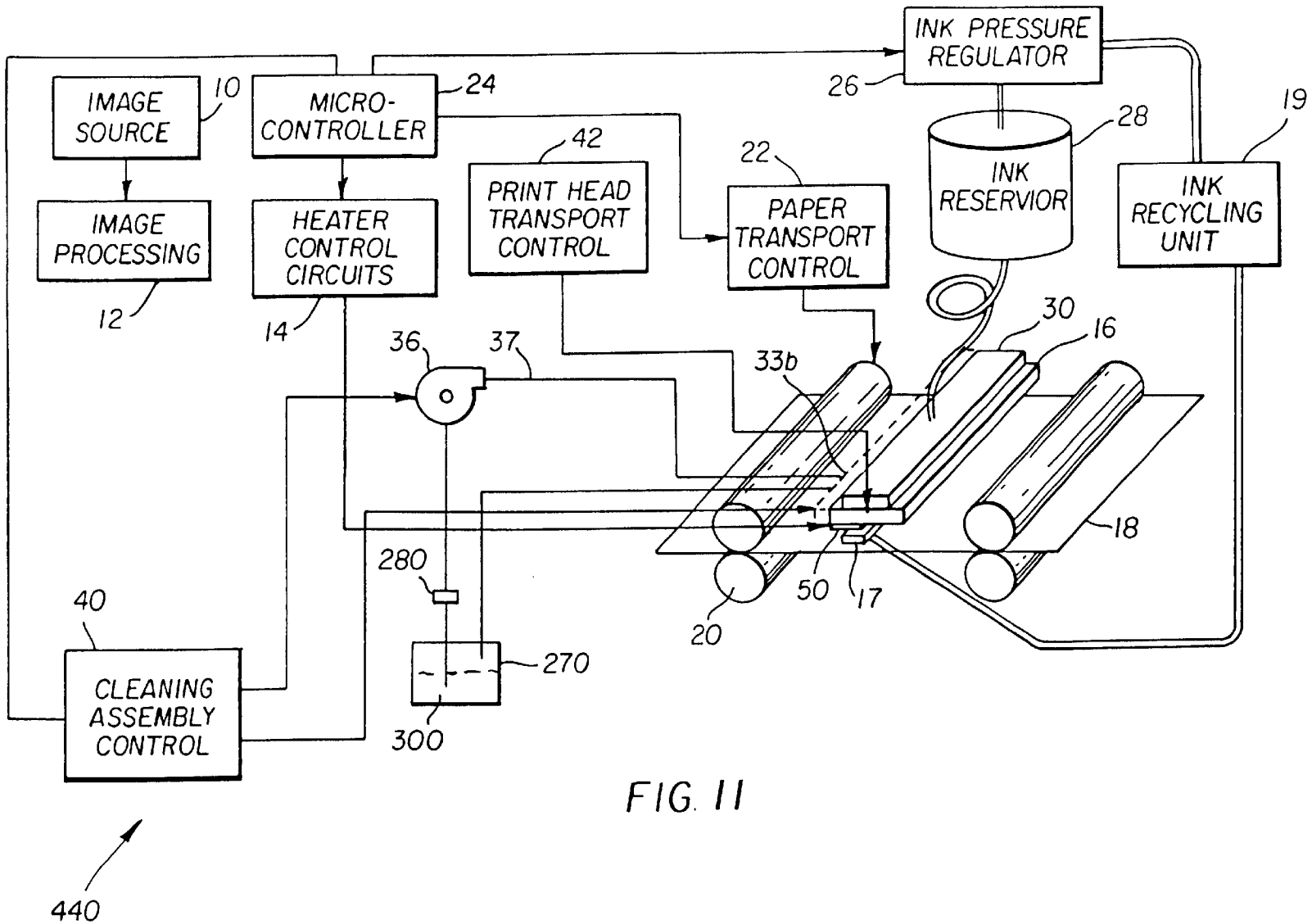
FIG. 11 shows a simplified block schematic diagram of an exemplary fourth embodiment printer equipped with a page width print head with fixed gutter and cleaning mechanism disposed on the same block as print head.
Figure 12:
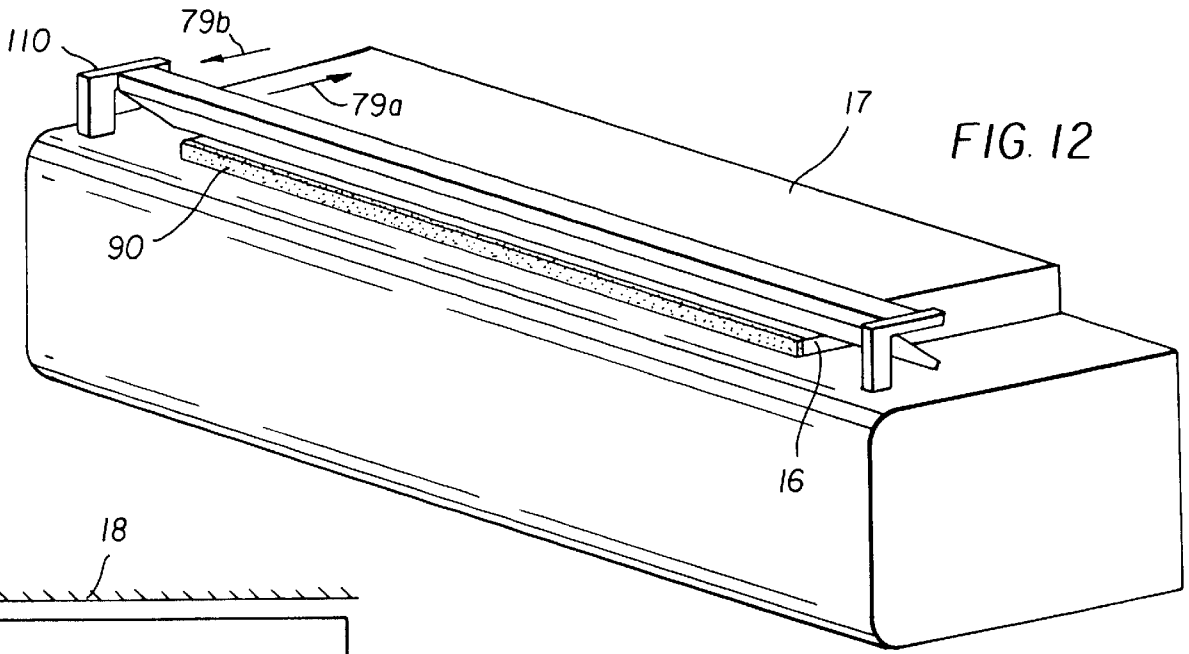
FIG. 12 an isometric view of print head with wiper blade assembly aligned for lengthwise translation, according to a third exemplary embodiment.
Figure 13:
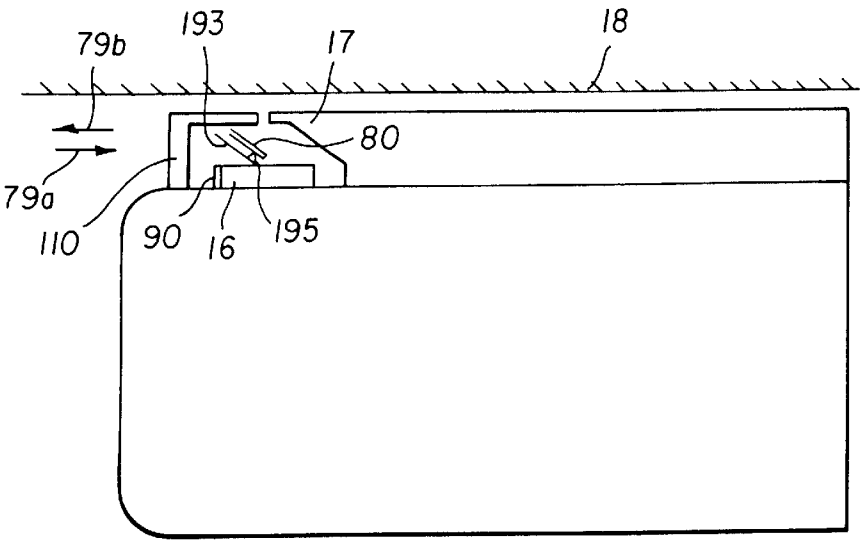
FIG. 13 shows a side view of the wiper blade assembly of FIG. 12.

Referring to FIGS. 11, 12 and 13, therein is shown a fourth embodiment ink jet printer system 440 capable of simultaneously removing contaminant 55 from print head surface 15 and nozzles 25. Fourth embodiment ink jet printer system 440 is substantially similar to third embodiment ink jet printer system 430, except the wiper blade 190 of the wiper blade assembly 33*b* is at least as long as the print head 16 and translates in direction of ninth arrow 79*a*. According to the fourth embodiment printer system 440, wiper blade assembly 33*b* is mounted adjacent to print head 16 and on same block as print head 16. Upon receiving an electrical signal from micro-controller 24 via cleaning assembly control 40, the wiper blade assembly 33*b* is caused to translate along the direction of ninth arrow 79*a* using frame 110 to ensure precise movement. The motor driving the wiper blade assembly 33*b* is not shown.

Micro-controller 24 via cleaning assembly motion controller 40 also provides electrical signals to activate cleaning liquid supply and vacuum to the canopy 80 during wiping action on surface 15. Also provided at the rest position of the wiper blade assembly 33*b* is an optional wiping pad 90 for removing dirt and drying the wiper blade 195. The wiping pad 90 may be made out of fibers or out of open cell foam materials, for example. The wiper blade assembly 33*b* may then be slid back while maintaining sliding contact with surface 15 along direction of fifth arrow 70*a* to its rest position. Alternatively the wiper blade assembly 33*b* may be lifted and then translated along direction of fourth arrow 79*b* to its rest position. Mechanisms for lifting and translation are not shown as they are well known in the art.

Figure 14:
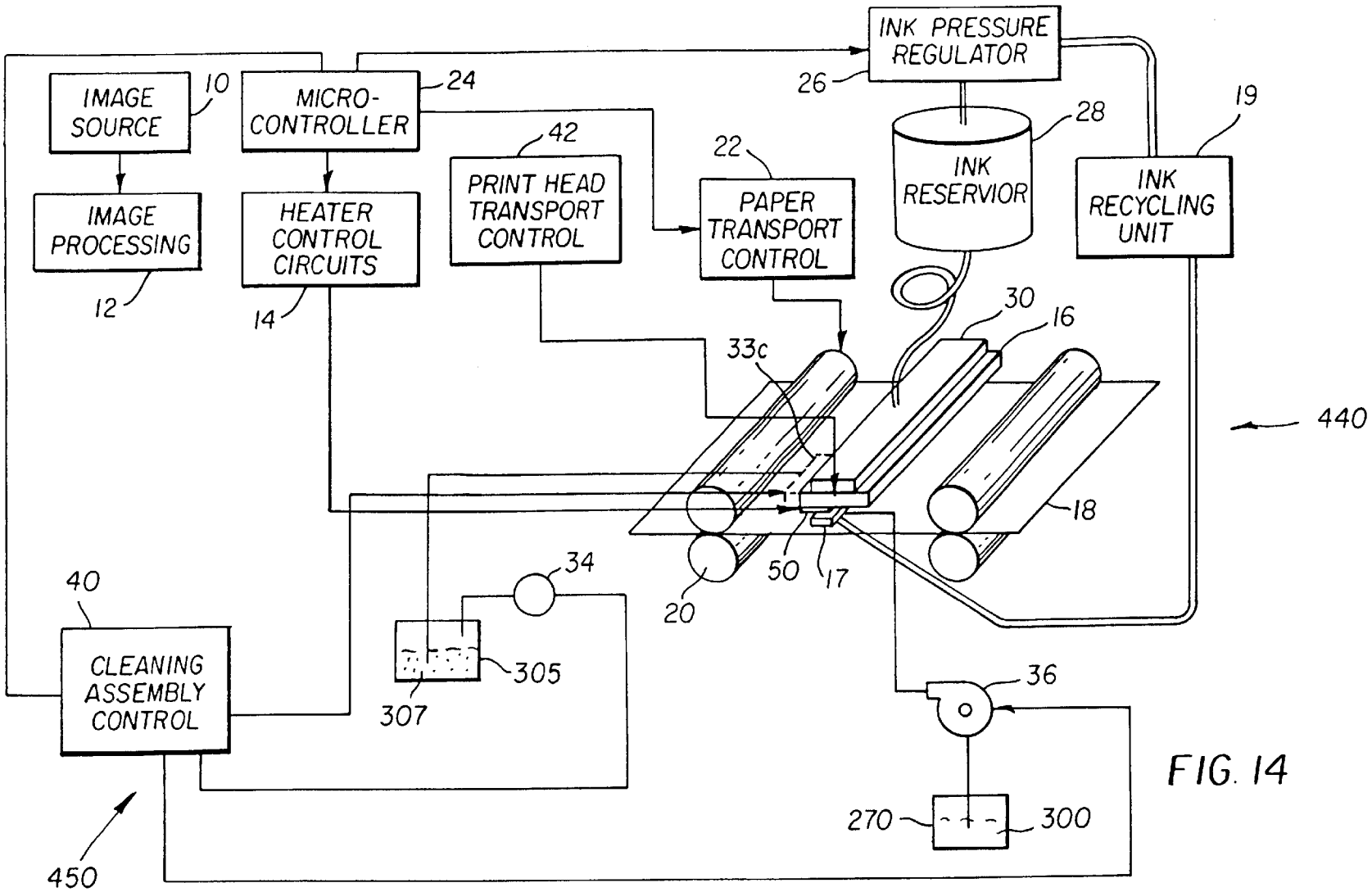
FIG. 14 shows a simplified block schematic diagram of an exemplary fifth embodiment printer equipped with a page width print head with fixed gutter and cleaning mechanism disposed on the same block as the print head wherein the cleaning liquid is supplied by channels in the fixed gutter.
Figure 15:
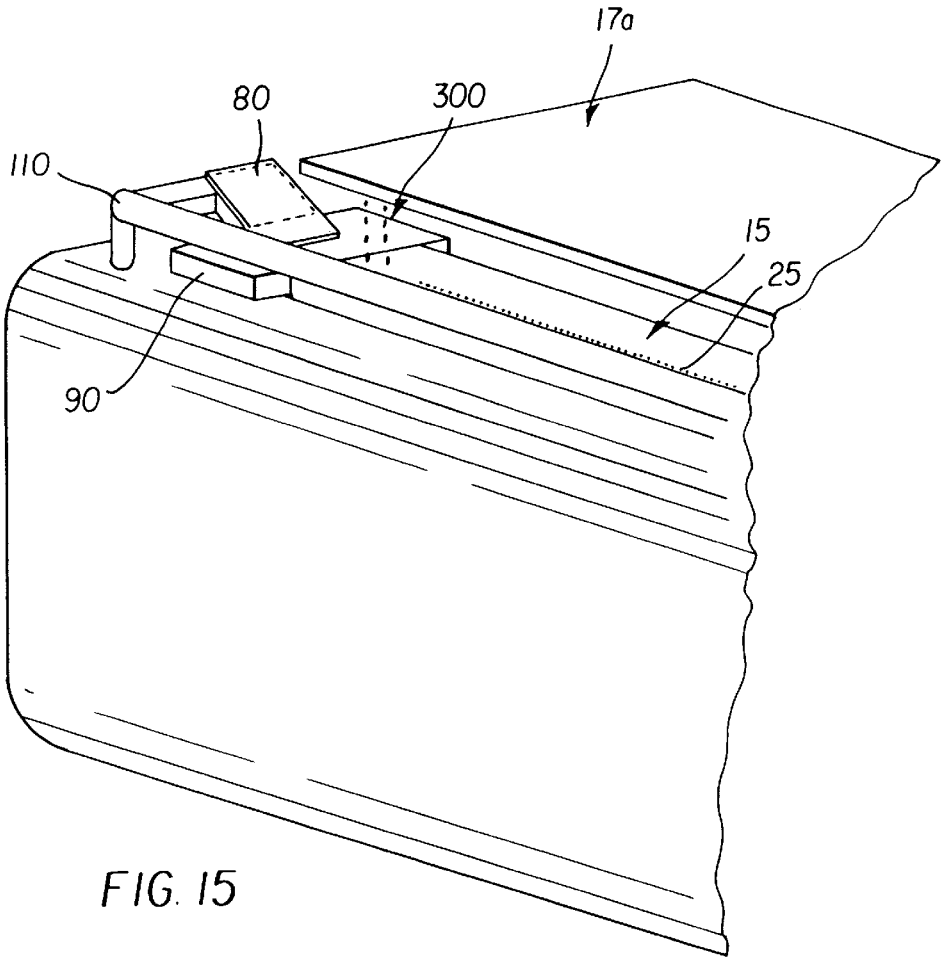
FIG. 15 shows an isometric view of the wiper-canopy assembly aligned in the widthwise translation mode and supply of cleaning liquid through fixed gutter.
Figure 16:
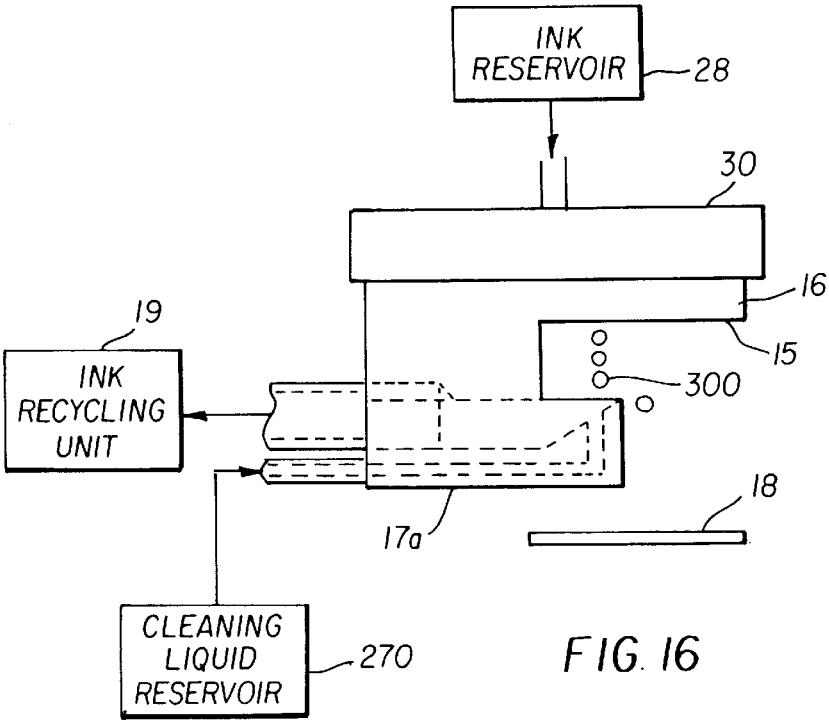
FIG. 16 shows a cross sectional view of a modified gutter provided with an internal cleaning liquid supply channel.

Referring to FIGS. 14 and 15, there is shown an example of a fifth embodiment of the ink jet printer system 450 capable of simultaneously removing contaminant 55 from print head surface 15 and nozzles 25. Fifth embodiment ink printer system 450 is substantially similar to first, second, third and fourth embodiment printer systems 400, 410, 420, and 430, respectively, except that the cleaning liquid 300 is supplied to the surface 15 through a modified gutter 17*a*. As shown in FIG. 16, the modified gutter 17*a* has an internal channel for delivering cleaning liquid to print head surface 15. Upon receiving an electronic signal from micro-controller 24 via cleaning assembly control 40, cleaning liquid is sprayed on to print head surface 15 either just before or during sliding contact between wiper blade assembly 33*c*. Suction is also simultaneously applied.

In the fifth embodiment, it is preferable that only suction is supplied to the wiper blade assembly 33*c*. The wiper body 193 and canopy 80 is also preferably constructed with just one channel to supply suction to gap 200 as cleaning liquid 300 is now delivered by modified gutter 17*a*. Cleaning liquid 300 delivered to print head surface 15 through modified gutter 17*a* is recovered from surface 15 by suction applied by vacuum pump 34 to gap 200. The used cleaning solution 305 is collected in a receptacle 307 and can be recycled. The arrangement for recycling is not shown.

Figure 17:
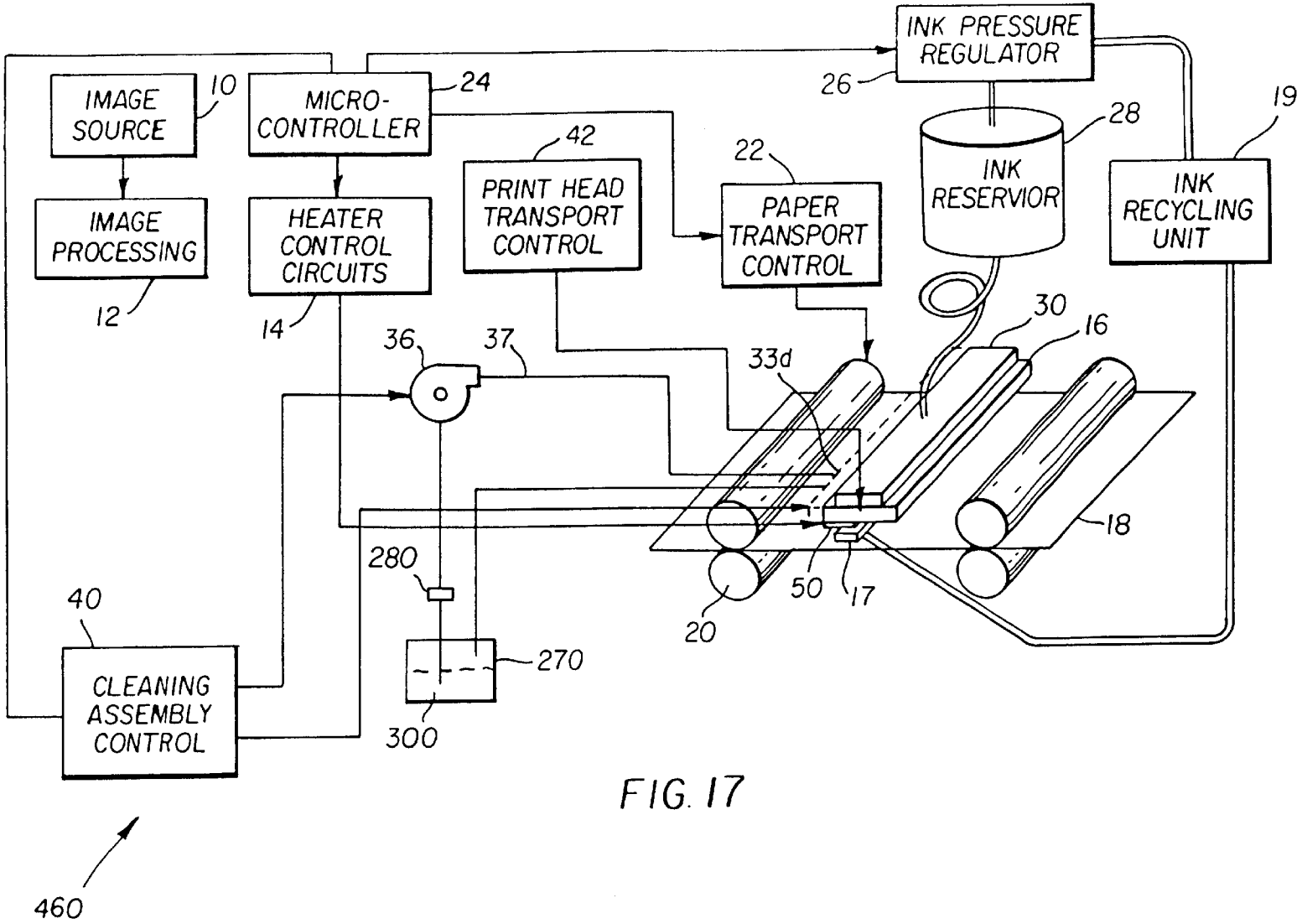
FIG. 17 shows a simplified block schematic diagram of an exemplary sixth embodiment printer equipped with a page width print head with fixed gutter and cleaning mechanism disposed on same block as print head using an ultrasonic transducer coupled to the wiper body.
Figure 18:
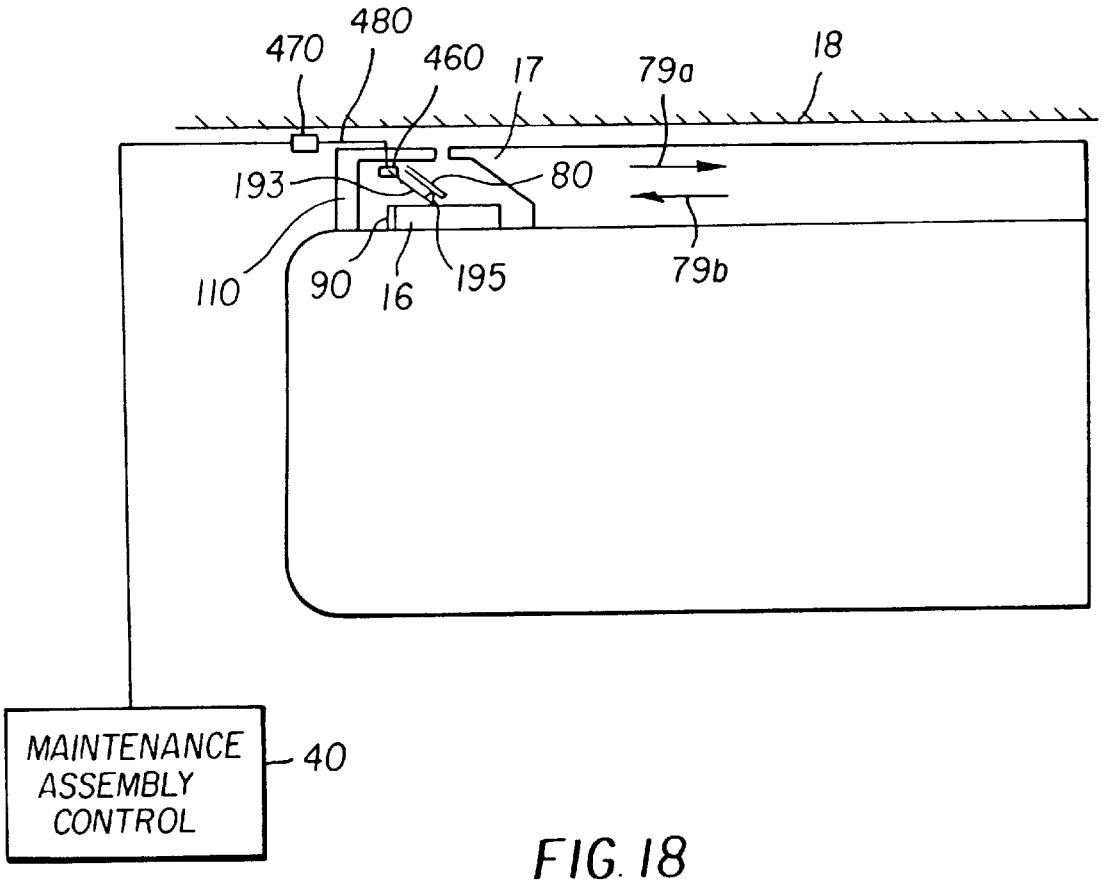
FIG. 18 shows a side view of wiper blade assembly combined with ultrasonic transducer aligned for lengthwise translation.

Referring to FIGS. 17 and 18, there is shown an example of a sixth embodiment of the ink jet printer system 460 capable of simultaneously removing contaminant 55 from print head surface 15 and nozzles 25. Sixth embodiment ink jet printer 450 is substantially similar to first, second, third, fourth and fifth embodiment ink jet printer systems 400, 410, 420, 430 and 440 except that the wiper blade assembly 33*d* or the wiper blade with internal channels 197 are combined with an ultrasonic transducer 460. By way of example and not by limitation, FIGS. 17 and 18 show a self-cleaning ink jet printer system 460 in which an ultrasonic transducer 460 is combined with a wiper blade assembly 33*d*. Electrical interface 470 transmits electrical signals and power from cleaning assembly control 40 to ultrasonic transducer 460 through electrical conduit 480. Obviously, the transducer 460 may be coupled with the wiper blade assembly 33*d* in a variety of ways, although only one example is shown in FIGS. 17 and 18. For example, the transducer 460 may be coupled to the cleaning liquid delivery piping or channels associated with the wiper blade assembly 33*d* and also cleaning liquid supply to the modified gutter 17*a*.

Therefore, what is provided and disclosed are variations and embodiments of self-cleaning printer system 400, 410, 420, 430, 440, 450 and 460 with corresponding wiper blade assemblies 32, 33*a*, 33*b*, 33*c*, 33*d* providing a mechanism and method of assembling corresponding self-cleaning printers with a cleaning mechanism 140 capable of simultaneously cleaning the print head surface 15 and nozzles 25 of the printer.

While the invention has been described with particular reference to its preferred embodiments, it will be understood by those skilled in the art that various changes may be made and equivalents may be substituted for elements of the preferred embodiments without departing from the invention. For example, the wiper blade material may be constructed of plastics, foam and felt. In addition, many modifications may be made to adapt a particular situation and material to a teaching of the present invention without departing from the essential teachings of the invention.

PARTS LIST

10 . . . image source
12 . . . image processing unit
14 . . . heater control circuits
15 . . . front surface
16 . . . print head
17 . . . gutter
17*a* . . . modified gutter
18 . . . recording medium
19 . . . ink recycling unit
20 . . . recording medium transport system
21 . . . non-deflected ink drop
22 . . . recording medium transport control system
23 . . . deflected ink drop
24 . . . micro-controller
25 . . . nozzle
26 . . . ink pressure regulator
28 . . . ink reservoir
29 . . . ink
30 . . . ink channel device
31 . . . ink channel
32 . . . wiper blade assembly
33*a* . . . wiper blade assembly
33*b* . . . wiper blade assembly
33*c* . . . wiper blade assembly
33*d* . . . wiper blade assembly including ultrasonic transducer
34 . . . vacuum pump
36 . . . circulation pump

38 . . . piping
40 . . . cleaning assembly motion control
42 . . . cleaning assembly motion control
44*a* . . . first arrow
44*b* . . . second arrow
46*a* . . . third arrow
46*b* . . . fourth arrow
50 . . . nozzle heaters
55 . . . contaminant
60 . . . ink droplet
63 . . . first axis
65 . . . second axis
70*a* . . . fifth arrow
70*b* . . . sixth arrow
75*a* . . . seventh arrow
75*b* . . . eighth arrow
77 . . . guide bar
79*a* . . . ninth arrow
79*b* . . . tenth arrow
80 . . . canopy
90 . . . wiping pad
110 . . . frame
140 . . . cleaning mechanism
190 . . . wiper blade assembly
193 . . . wiper body
195 . . . edge
197 . . . wiper blade with internal channels
250 . . . cleaning liquid channel in canopy
260 . . . suction channel in canopy
270 . . . cleaning liquid reservoir
300 . . . cleaning liquid
305 . . . used cleaning liquid
307 . . . used cleaning liquid receptacle
400 . . . first embodiment printer system
410 . . . second embodiment printer system
420 . . . third embodiment printer system
430 . . . fourth embodiment printer system
440 . . . fifth embodiment printer system
460 . . . ultrasonic transducer
470 . . . electrical interface for ultrasonic transducer
480 . . . electrical conduit

What is claimed is:

1. A self-cleaning ink jet printer, comprising:

a print head having a surface thereon;

an ink reservoir containing ink;

a gutter integrally connected to said print head for intercepting said ink in a non-printing mode; and a cleaning assembly for cleaning said print head surface, said cleaning assembly including a wiper blade assembly, wherein said wiper blade assembly further comprises a canopy having a channel for delivery and a channel for vacuum suction of a cleaning liquid.

2. The ink jet printer of claim 1, wherein said canopy is mounted on said wiper body to form a gap between said wiper blade and said canopy to facilitate delivery and suction of said cleaning liquid.

3. The ink jet printer of claim 1, wherein said cleaning assembly further comprises:

(a) a filter for removing contaminants from said liquid returned through said vacuum suction of said canopy;

(b) a vacuum pump to provide suctioning of said liquid; and (c) a liquid reservoir;

wherein said liquid is delivered to said print head surface by said channel for delivery in said canopy and suctioned back through said channel for vacuum suction to said filter whereby said contaminants are removed from said liquid returned through said channel for vacuum suction before being discharged to said liquid reservoir to be dispensed back through said channel for delivery of said canopy.

4. A cleaning mechanism for an ink jet printer with a print head having a surface containing a plurality of orifices therein, said printer having a gutter integrally connected to said print head for intercepting ink in a nonprinting mode, said assembly comprising:

(a) a wiper blade assembly for cleaning said print head surface;

(b) a means for moving, positioning, and aligning said wiper blade assembly;

(c) a canopy for facilitating flow of a cleaning liquid to said print head surface;

(d) a means for delivery of said cleaning liquid;

(e) a means for vacuum suction of said cleaning liquid;

(f) a filter for removing contaminants from said liquid returned through said vacuum suction of said canopy;

(g) a vacuum pump to provide suctioning of said liquid; and (h) a liquid reservoir wherein said liquid is delivered to said print head surface by said means for delivery and suctioned back through said means for suction to said filter whereby said contaminants are removed from said liquid returned through said means for suction before being discharged to said liquid reservoir to be dispensed back through said means for delivery.

5. The cleaning mechanism of claim 4, wherein said wiper blade assembly further comprises:

(a) a wiper blade of elastomeric material for cleaning said print head surface, said wiper blade having a beveled edge with a substantially triangular shape; and (b) a wiper body for moving and connecting said wiper blade to said canopy.

6. The cleaning mechanism of claim 5, wherein said wiper blade assembly further comprises a wiper blade of elastomeric material for cleaning said print head surface, said wiper blade having a beveled edge with a substantially triangular shape.

7. The cleaning mechanism of claim 4, wherein said canopy further comprises channels for delivery and suction of said cleaning liquid, said canopy channels positioned to align with said means for delivery and suction of said cleaning system to facilitate transmission of liquid to said surface.

8. The cleaning mechanism of claim 4, wherein said wiper blade assembly further comprises channels for delivery and suction of said cleaning liquid, said channels positioned to align with said means for delivery and suction of said cleaning system to facilitate transmission of liquid to said surface.

9. The cleaning mechanism of claim 8, wherein said wiper blade assembly further comprises a transducer.

10. The cleaning mechanism of claim 4, wherein said wiper blade assembly further comprises a channel for suction of said cleaning liquid, said channel positioned to align with said means for suction of said cleaning system to facilitate suction of liquid from said surface.

11. The cleaning mechanism of claim 4, wherein said means for delivery of said cleaning liquid is located in said gutter.

12. The cleaning mechanism of claim 11, wherein said canopy is adapted to contain said means for suction of said cleaning liquid.

13. The cleaning mechanism of claim 4, wherein said cleaning liquid is said ink, whereby said ink is delivered by a pressure regulator through said nozzles.

14. A wiper blade assembly of a self-cleaning ink jet printer with a print head having surface containing a plurality of nozzles therein, said printer having a gutter integrally connected to said print head for intercepting ink flowing through said nozzles in a non-printing mode and a mounting block, said assembly comprising:

(a) a wiper blade for cleaning said print head surface;

(b) a means for moving, positioning, and aligning said wiper blade;

(c) a canopy attached to said wiper blade and having a channel for delivery and a channel for vacuum suction of a cleaning liquid;

(d) a filter for removing contaminants from said liquid returned through said vacuum suction of said canopy;

(e) a vacuum pump to provide suctioning of said liquid; and (f) a liquid reservoir;

wherein said liquid is delivered to said print head surface by said delivery channel in said canopy and suctioned back through said vacuum channel to said filter whereby said contaminants are removed from said liquid returned through said channel before being discharged to said liquid reservoir to be dispensed back through said delivery channel of said canopy.

15. The wiper blade assembly of claim 14 wherein said wiper blade further comprises:

(a) a wiper body for moving and connecting said wiper blade to said canopy; and (b) a wiper pad for cleaning said wiper blade.

16. The wiper blade assembly of claim 14, wherein said means for moving, positioning, and aligning said wiper blade further comprises a mechanism for lifting and translating said wiper blade across said print head.

17. The wiper blade assembly of claim 14, further comprising an ultrasonic transducer.

18. The wiper blade assembly of claim 14, wherein said canopy is mounted adjacent to said print head on said mounting block.

19. The wiper blade assembly of claim 18, wherein said means for moving, positioning, and aligning is configured to move said wiper blade along a y-axis of said print head to effectuate cleaning.

20. The wiper blade assembly of claim 18, wherein said wiper blade and canopy is at least equal in length to said print head.

21. The wiper blade assembly of claim 20, wherein said means for moving, positioning, and aligning is configured to move said wiper blade along a x-axis of said print head to effectuate cleaning.

22. A self-cleaning inkjet printer, comprising:

(a) a print head having a surface thereon;

(b) an ink reservoir containing ink;

(c) a gutter integrally connected to said print head for intercepting said ink in a non-printing mode; and (d) a cleaning assembly having a wiper blade assembly for cleaning said print head surface, said wiper blade assembly having a cleaning liquid delivery channel and a cleaning liquid removal channel, said wiper blade assembly having a canopy including at least a portion of said cleaning liquid delivery channel and at least a portion of said cleaning liquid removal channel, wherein said wiper blade assembly is operable to contact said print head.

* * * * *